US006578675B2

(12) United States Patent
Wilson et al.

(10) Patent No.: US 6,578,675 B2
(45) Date of Patent: Jun. 17, 2003

(54) ELEVATOR INFORMATION AND ADVERTISING DELIVERY SYSTEM

(75) Inventors: Thomas Wilson, Mooresville, NC (US); William G. Thomas, Jr., Tega Cay, SC (US)

(73) Assignee: Elevator Channel, LLC, The, Mooresville, NC (US)

( * ) Notice: Subject to any disclaimer, the term of this patent is extended or adjusted under 35 U.S.C. 154(b) by 0 days.

(21) Appl. No.: 10/010,416

(22) Filed: Dec. 6, 2001

(65) Prior Publication Data

US 2002/0066621 A1 Jun. 6, 2002

Related U.S. Application Data

(60) Provisional application No. 60/251,635, filed on Dec. 6, 2000.

(51) Int. Cl.[7] ..... B66B 1/34; B66B 3/00

(52) U.S. Cl. ..... 187/391; 187/393; 187/396; 187/414; 187/247; 187/380; 187/381; 187/382

(58) Field of Search ..... 187/391, 393, 187/396, 414, 247, 380, 381, 382

(56) References Cited

U.S. PATENT DOCUMENTS

| | | | | | |
|---|---|---|---|---|---|
| 4,677,779 | A | | 7/1987 | Rodriguez | |
| 4,853,678 | A | | 8/1989 | Bishop, Jr. et al. | |
| 5,131,508 | A | * | 7/1992 | Suzuki | 187/380 |
| 5,606,154 | A | | 2/1997 | Doigan et al. | |
| 5,714,726 | A | * | 2/1998 | Ketoviita | 187/247 |
| 5,844,181 | A | | 12/1998 | Amo et al. | |
| 5,955,710 | A | * | 9/1999 | DiFranza | 187/247 |
| 6,073,375 | A | | 6/2000 | Fant et al. | |
| 6,073,727 | A | | 6/2000 | DiFranza et al. | |
| 6,082,500 | A | * | 7/2000 | Amo et al. | 187/391 |
| 6,206,142 | B1 | * | 3/2001 | Meacham | 187/392 |
| 6,250,428 | B1 | | 6/2001 | Amo et al. | |
| 6,288,688 | B1 | | 9/2001 | Hughes et al. | |
| 6,341,668 | B1 | * | 1/2002 | Fayette et al. | 187/247 |
| 6,349,797 | B1 | | 3/2002 | Bayer et al. | |
| 2002/0007987 | A1 | | 1/2002 | Amo et al. | |
| 2002/0036122 | A1 | | 3/2002 | Fayette et al. | |

* cited by examiner

*Primary Examiner*—Jonathan Salata

(57) ABSTRACT

An apparatus and method for delivering advertising messages to occupants of an elevator cab includes a network mainframe server located remotely from the elevator cab. The apparatus further includes an individual processing unit (IPU) located at the elevator cab and in communication with the network mainframe server over a telephone line configured for transmitting a digital data signal. The IPU includes a central processing unit (CPU) and a monitor electrically connected to the CPU. In a particular embodiment, the IPU further includes an infrared camera for detecting the number of occupants in the elevator cab when an advertising message is displayed. The network mainframe server transmits the advertising messages to the CPU of the IPU over the telephone line. The advertising messages are stored on the CPU and displayed to the occupants of the elevator cab on the monitor of the IPU.

18 Claims, 3 Drawing Sheets

ELEVATOR INFORMATION AND ADVERTISING DELIVERY SYSTEM

CROSS REFERENCES TO RELATED APPLICATIONS

This application claims the benefit of priority of U.S. Provisional Application Serial No. 60/251,635 filed Dec. 6, 2000.

FIELD OF THE INVENTION

The invention relates to a system for delivering information and advertising to the occupants of an elevator. More particularly, the invention is a cost effective and reliable apparatus and method for delivering audio/video information and targeted advertising to the occupants of an elevator without utilizing a closed circuit television, LAN or Internet feed.

BACKGROUND OF THE INVENTION

For most individuals, an elevator is an uncomfortable environment. Behavioral scientists theorize that people feel uncomfortable in an elevator because it presents an environment in which the occupant experiences a lack of control. Once the elevator doors close, the occupant must remain inside until the elevator reaches its destination and the doors reopen. Furthermore, the elevator environment is perceived as being crowded, constrained, and often unpleasant due to the presence of concentrated odors, such as cigar smoke, food or perfume. As a result, many individuals consider the elevator environment to be an invasion of their "personal space," regardless of the number of occupants riding in the elevator. These feelings and perceptions are only exacerbated in urban high-rise office buildings where hurried individuals share elevator rides with a greater number of people for longer periods of time.

The uncomfortable feeling experienced by many individuals is most apparent from observing the change in the behavior of individuals once they enter an elevator. Most people are reluctant to speak to other elevator riders. Eye contact with other occupants is also generally kept to a minimum. The occupant's gaze is typically fixated on the floor, on the doors of the elevator, on the control panel to one side of the doors, or on the floor indicator lights positioned on the control panel or above the doors. Riders often fidget and nervously adjust their clothing or belongings. Some attempt to read or even work on a battery powered electronic device, such as a personal digital assistant (PDA) or personal computer, during the relatively short elevator ride in an attempt to overcome the intense feelings of uneasiness they experience while riding in an elevator.

Since so many, if not most, people are uncomfortable and experience feelings of uneasiness in the elevator environment, elevator operators and building managers have long sought ways to put elevator riders more at ease. Such attempts have included the playing of "easy listening" music in elevator cabs. The playing of music in elevator cabs has become so prevalent that the type of easy listening music typically played in elevators is now often referred to as "elevator music." Elevator operators and building managers have also placed printed information, and in particular printed advertising, in elevator cabs to give occupants something on which to focus their attention and pass the time. More recently, electronic media, such as stock tickers, news banners and building information systems have been introduced into the elevator environment. These electronic media are operated from a closed circuit television signal, Local Area Network (LAN) or Internet feed. Increasingly, the electronic media are relying on electronic advertising to generate sufficient revenue to pay the high cost of installing, configuring, and operating the necessary closed circuit television, LAN, or Internet feed equipment. Such elevator advertising systems are disclosed in U.S. Pat. No. 6,288,688 to Hughes et al., U.S. Pat. No. 6,082,500 to Amo et al., U.S. Pat. Nos. 6,073,727 and 5,955,710 to DiFranza, and U.S. Pat. No. 5,606,154 to Doigan et al.

Given that the elevator environment is so uncomfortable, it may seem surprising at first that advertising in elevator cabs would be more than only marginally effective. However, statistics compiled from the 1995 Ryerson Polytechnic Institute/Capilano College Study on the elevator audience and the effects of print advertising in elevator cabs reveal that elevator advertising is certainly one of the most, of not the most, effective forms of advertising. In particular, the Study showed that: (1) 68% of all elevator riders are 21–39 years of age; (2) 45% of elevator riders have annual incomes exceeding $35,000; (3) 71% live in households that include 2 or more individuals; (4) 85% work in "white collar" occupations; and (5) 51% have completed post-secondary education. These results reveal that elevator riders as a group tend to be young, active, upwardly mobile, and having a high level of disposable income. It is widely known that individuals sharing the above characteristics fall within the target demographics of the majority of advertisers.

More than merely providing the right audience, however, elevators provide a desirable environment for advertising. The Ryerson/Capilano Study further revealed that: (1) elevator print advertising achieved the highest recorded unaided medium awareness score with 84% of elevator occupants reporting that they were "aware" of the advertising; (2) elevator print advertising also achieved the highest recorded aided media recall score with 96% of elevator occupants able to recall the advertising when queried; (3) more than 85% of occupants' comments regarding the elevator print advertising were favorable; and (4) 82% of the elevator riders felt that print advertising placed in elevators is interesting to read. These results reveal that elevators provide a captive target audience with a high retention rate at a time of day when the elevator occupant is alert, focused and attentive. In view of such overwhelming statistics, there is no reason to believe that audio/video advertising in elevator cabs would not be equally, if not more, effective than print advertising.

However, there are serious obstacles presently facing audio/video advertising in elevator cabs. As previously mentioned, there is the high cost of installing, configuring and operating an entire bank of elevators with closed circuit television, LAN, or Internet feed equipment. In addition, there are difficulties associated with determining the number of occupants that are exposed to each advertisement for the purposes of establishing billing rates and collecting advertising revenues. Accordingly, it is apparent that there is a need for an elevator information and advertising delivery system that is cost effective to install, configure and operate. It is further apparent that there exists a need for an elevator information and advertising delivery system that reliably determines the number of elevator occupants that are exposed to each advertisement for the purposes establishing billing rates and collecting advertising revenues.

BRIEF SUMMARY OF THE INVENTION

The present invention provides a system, and in particular, an apparatus and method for delivering advertising messages to occupants of an elevator cab that overcomes the disadvantages of elevator cab message systems discussed above. The apparatus includes a network mainframe server located remotely from the elevator cab. The apparatus further includes an individual processing unit (IPU) located at the elevator cab and in communication with the network mainframe server over a telephone line configured for transmitting a digital data signal. The IPU includes a central processing unit (CPU) for storing pre-recorded advertising messages and for replaying the pre-recorded advertising messages to the occupants of the elevator cab. The IPU further includes a monitor electrically connected to the CPU for displaying the advertising messages to the occupants of the elevator cab.

In a particular embodiment, the IPU further includes an infrared camera electrically connected to the CPU for detecting the number of occupants in the elevator cab when an advertising message is displayed on the monitor. Preferably, the infrared camera is optically connected to the CPU by a fiber optic cable. In another aspect, the IPU further includes a speaker electrically connected to the CPU and the advertising messages consist of audio/video files transmitted to the IPU from the network mainframe server. In another aspect, the telephone line includes terminals located in the elevator cab and the CPU is connected to the terminals of the telephone line by an xDSL data line.

The method includes the step of providing a network mainframe server located remotely from the elevator cab. The method includes the further step of providing an individual processing unit (IPU) located at the elevator cab and in communication with the network mainframe server. The IPU includes a central processing unit (CPU) and a monitor electrically connected to the CPU. The network mainframe server transmits the advertising messages from the network mainframe server to the CPU of the IPU over a telephone line. The advertising messages are stored on the CPU of the IPU displayed to the occupants of the elevator cab on the monitor of the IPU. In a particular embodiment, the method includes the further steps of providing an infrared camera connected to the CPU of the IPU and detecting the number of occupants in the elevator cab when an advertising message is displayed on the monitor.

BRIEF DESCRIPTION OF THE DRAWINGS

The accompanying drawings are included to provide a further understanding of the invention and are incorporated in and constitute a part of this specification, illustrate one or several embodiments of the invention, and, together with the description, serve to explain the principles and objectives of the invention. More particularly.

DETAILED DESCRIPTION OF THE PREFERRED EMBODIMENTS OF THE INVENTION

Figure 1:
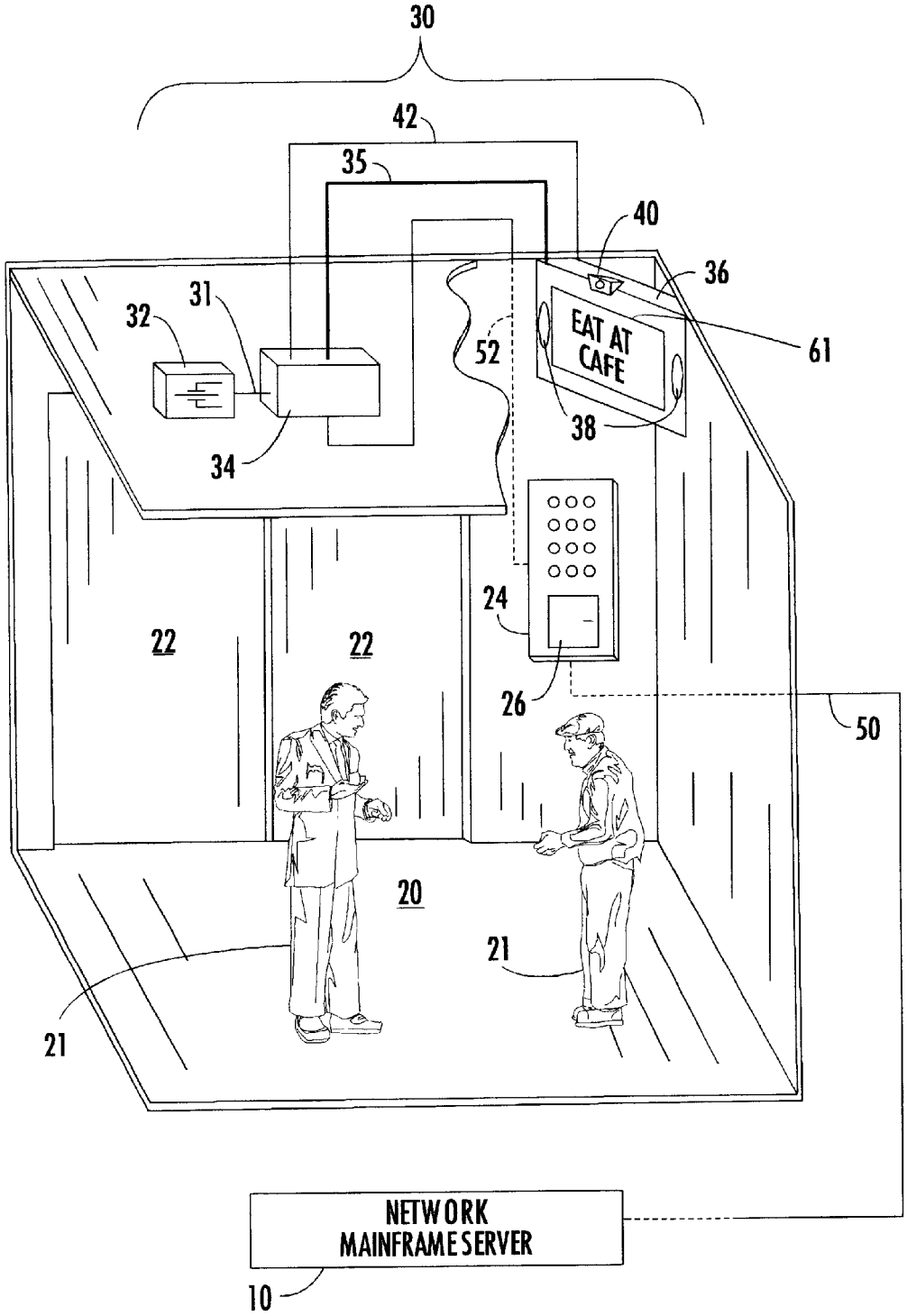
FIG. 1 is a schematic illustration of an apparatus for providing an elevator cab with an elevator information and advertising delivery system according to the present invention.

In view of the deficiencies in the known elevator information and advertising delivery systems noted above, it is an object of the present invention to provide an apparatus and method for delivering audio/video information and advertising to the occupants of an elevator cab that is cost effective to install, configure and operate. It is a further object of the present invention to provide an apparatus and method for an elevator information and advertising delivery system that reliably determines the number of elevator occupants that are exposed to each advertisement for the purpose of establishing billing rates and collecting advertising revenues. Additional features and advantages of the invention will be set forth in the description that follows, and, in part, will be apparent from the description, or may be learned by practice of the invention. The objectives, features, and advantages of the invention will be realized and attained by the illustrative elevator information and advertising delivery system described in the written description hereof, and illustrated in accompanying drawings.

To achieve these objectives, features, and advantages, and in accordance with the purpose of the invention as embodied and broadly described herein, the present invention is directed broadly to an elevator information and advertising delivery system that does not require the use of closed circuit television, LAN, or Internet feed equipment. In addition, the system of the present invention reliably determines the number of occupants that are exposed to each advertisement without obtrusively infringing on the privacy rights of the occupants of the elevator. In the broadest sense, the invention is an apparatus and method for delivering information and advertising to the occupants of an elevator. The system provider will contract with building owners or operators and property managers to provide the information and advertising service in the elevator cabs located in a building, typically an office or professional building in an urban area. At the same time, the system provider will contract with various information content providers and/or advertisers to obtain information and ads to be featured on the system. Typically, the system provider will operate from a Home Office having conventional Marketing, Sales, Installation, Programming, Maintenance/Service, and Billing/Accounts Payable departments.

The apparatus of the system includes a network mainframe server 10 (FIG. 2) located at the Home Office. The network server 10 typically includes a high-speed processor, large memory capacity, and high-speed modem or other telecommunications hardware. The network server 10 also comprises conventional word processing, database, audio/video sequencing, network, and communications software. The network server 10 is connected to each of the elevator cabs 20 located in the buildings in which the system is provided through a Wide Area Network (WAN) administered over a telecommunications system, for example a conventional telephone system. A Network Administrator from the Programming department determines the maximum number of elevator cabs 20 that can be connected to a particular network server 10 while still maintaining efficient, reliable service. As required, additional network servers 10 will be placed into service, at which time a central database server 15 (FIG. 2) may also be introduced into the system to consolidate, for example, programming, billing, and accounts payable functions.

As illustrated in FIG. 1, each elevator cab 20 connected to the network server 10 via the WAN is provided with an individual processing unit (IPU) 30. As previously mentioned, each IPU 30 is connected to the network server 10 through a telephone connection. In a preferred embodiment, the IPU 30 comprises a fully functional computer including a power source 32, a central processing unit (CPU) 34, a monitor 36, and at least one audio speaker 38. Preferably, the CPU 34 is a Toshiba 8000S Desktop Tower, such as Model No. PV1057U-6JD52. Preferably, the monitor 36 is a flat panel display, for example, a Toshiba TekBright 60A 15.1 inch Flat Panel Monitor, such as Model No. PV2022U-01. The mouse and keyboard of the computer will be utilized to install, configure, and service the IPU 30, but typically will be removed for operation. The IPU 30 will also comprise the necessary software to perform all of the functions of receiving, recording, storing, manipulating, and displaying audio/video files, such as MPEG, MPEG II, and MP3 files, without distortion or loss of file integrity for the expected duration of use. For purposes of example and not by way of limitation, the software applications of the IPU 30 may comprise Windows '95, '98 or 2000 or NT operating system, XingTech MPEG Player sequencing software, and conventional networking and communications software, such as PC Anywhere.

Each power source 32, CPU 34, flat panel monitor 36, and speaker 38 is mounted in the elevator cab 20 in accordance with local, state and federal guidelines, codes, and regulations. As permissible, each IPU 30 is custom fit to the architectural characteristics of the interior of the particular elevator cab 20. For example, the flat panel monitor 36 may be mounted above the doors 22 of the elevator cab 20, or in a front, upper corner of the elevator cab 20 so that the forward-facing occupants will have an unobstructed view of the monitor 36. The CPU 34 may be mounted inconspicuously on the top of the elevator cab 20 with existing electrical and HVAC equipment, or may be mounted directly behind the monitor 36. Similarly, the CPU 34 may be recessed into a wall or the ceiling of the elevator cab 20 to further conceal the CPU 34 from the view of the occupants. In a particular embodiment, the monitor 36 is mounted in a front corner of the elevator cab 20 near the ceiling using an interior mount (not shown) designed to match or blend into the elevator decor. The CPU 34 is included in the interior mount and is hidden from view behind the monitor 36. The CPU 34, monitor 36 and speaker(s) 38 receive power from an electrical cord 31, surge protector, and transformer (if required) electrically connected to the existing power source 32. Preferably, an unobtrusive opening is made in the ceiling tiles behind the monitor 36 to route the electrical cord 31 to the power source 32, such as an AC outlet, on the top of the elevator cab 20.

Multiple telephone lines, or a single telephone line having multiple extensions, are added to the building entrance terminal (BET) from the local telephone exchange. The additional line(s) may be ISDN, xDSL (e.g., ADSL), T1 or fiber optic depending on building codes, local availability, and cost constraints. Preferably, the telephone line extension for the information and advertising delivery system is carried by the telephone line 50 for the emergency phone located in the elevator cab 20. As a result, the cost of installing a separate extensible telephone cable in the elevator shaft is avoided. The elevator control panel 24 is then equipped with a Plain Old Telephone Service (POTS) splitter or an xDSL splitter, such as a low pass filter, that filters (i.e., separates) a low frequency POTS telephone line signal and/or a high-speed digital data line signal from a combined signal for simultaneous use. Accordingly, emergency phone service will remain available to the occupants of the elevator cab 20 at all times. In another embodiment, the data line for the information and advertising delivery system and the emergency phone line are separate.

As shown in FIG. 1, the data line 52 for the information and advertising delivery system is run between the line terminals 26 at the emergency phone (e.g., xDSL splitter) and the CPU 34 of the IPU 30. Preferably, the data line 52 is routed from the line terminals 26 at the control panel 24 behind the interior wall of the elevator cab 20 to the top of the elevator cab 20 and into the CPU 34 through the hole provided in the ceiling tile for the power supply cord 31. In many areas, particularly in the United States, a local exchange carrier (LEC) will be required to transmit the signal from the Home Office over the local telephone network and then through the building transport cabling to the elevator cab 20. The majority of LECs, and particularly LECs that service urban areas, utilize DSL technology and common dial tone service to obtain the advantages of high bit capacity and high bits per second (bps) transfer rate. Accordingly, the telephone line 50 with combined POTS signal and digital data signal will already be in service, or will be readily available upon request of the system provider. As a result, the elevator information and advertising delivery system will be cost effective to install, configure and operate.

As also shown in FIG. 1, the apparatus of the invention further comprises an infrared camera 40 and associated fiber optic cable 42. The infrared camera 40 is utilized to record, store and transmit optical data that is used by the network mainframe server 10 to process reporting and billing information, as will be described hereinafter in greater detail. The infrared camera 40 may be any conventional optical data recording device, for example, Camera Model No. CAM\IR-2100, which is commercially available from Infrared, Inc. The infrared camera 40 is equipped with infrared imaging software that is suitable for distinguishing heat emanations from a mass of individuals in a crowded enclosure, such as an elevator cab 20. An example of suitable infrared imaging software is \IR2000, which likewise is commercially available from Infrared, Inc. The infrared camera 40 is mounted in the elevator cab 20 in the vicinity of the flat panel monitor 36. Preferably, the infrared camera 40 is mounted above, below, or beside the monitor 36 so that the optical data recorded by the infrared camera 40 will provide an indication whether the occupants' attention is directed to the monitor 36. However, the infrared imaging software utilized with the infrared camera 40 intentionally will not have sufficient resolution processing capability to identify the occupants of the elevator cab 20. The identity of the occupants is not required for any operational aspect of the system and it is believed that imaging resolution sufficient to identify individuals would be more costly to install, configure and operate, and could violate existing privacy laws or laws that may be enacted in certain jurisdictions in the future.

Installation of the apparatus of the elevator information and advertising delivery system will typically be accomplished by an elevator maintenance company contracted by the building owner, operator or manager. However, the system provider may also provide an installation team that is dispatched to the building to install the apparatus in each elevator cab. Regardless, the installer will be provided with the equipment previously described, any necessary mounts and hardware, and instructions for installing the apparatus in the particular type of elevator cab 20. The required applications software and optical imaging software is previously installed and configured in the CPU 34 and the infrared camera 40, respectively. Typically, the monitor panel mount is affixed to the interior of the elevator cab 20 using appropriate hardware, such as wood or machine screws. A small opening is then cut in the ceiling tile of the elevator cab 20 behind the monitor panel mount to access the power source 32. If the CPU 34 is mounted on the top of the elevator cab 20, it is suitably secured and electrically connected to monitor 36 by cable 35. The cable 35, including any cabling for the mouse and keyboard, and the fiber optic cable 42 for the infrared camera 40 are routed through the opening in the ceiling tile to the interior of the elevator cab 20. Otherwise, the CPU 34 is secured behind the monitor 36 and the power cord 31 is routed through the opening in the ceiling tile to the power source 32 on top of the elevator cab 20. The data line 52 is then spliced to the POTS or xDSL splitter and routed in a convenient manner to the CPU 34, such as behind an interior wall and through the opening in the ceiling tile of the elevator cab 20. The appropriate communications and electrical connections are then made and the apparatus is configured for receiving programming instructions from the Home Office via the telephone line 50.

Figure 2:
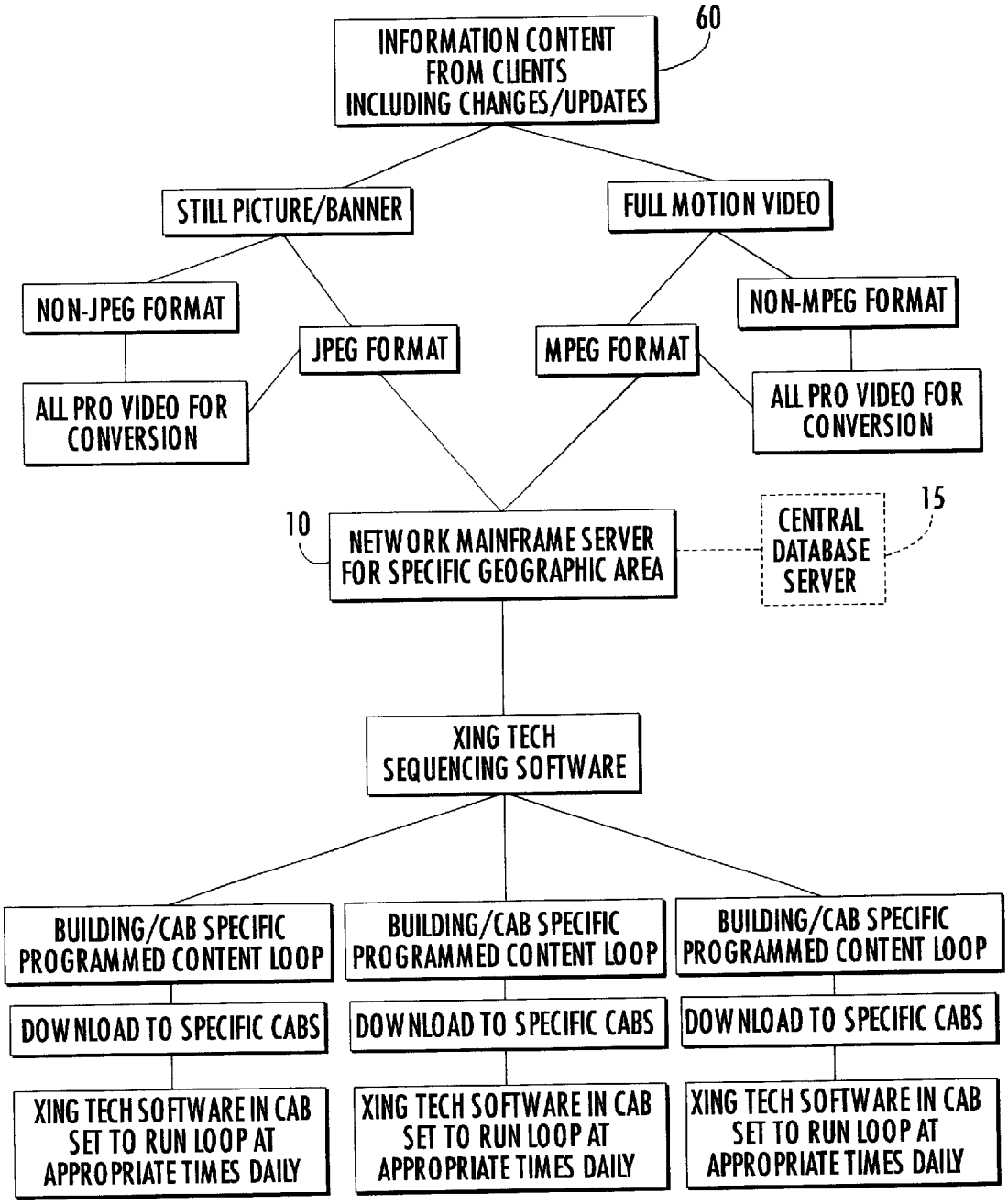
FIG. 2 is a flow chart illustrating a method for acquiring, storing and displaying audio/video information and advertising for use with an elevator information and advertising delivery system according to the present invention.

Once installed and configured, the CPU 34 of the IPU 30 can be accessed and programmed via the remote Home Office network mainframe server 10 using the PC AnyWhere networking and communications software on the operating system platform. The networking and communications software will permit the network server 10 to access the CPU 34 of each elevator cab 20 to perform routine diagnostics, to perform information and advertising configurations and updates, as will be described hereinafter, and to receive occupant information from the CPU 34 via the infrared camera 40, as will be described hereinafter. As illustrated in FIG. 2, information and ad placement requests are obtained by sales personnel from information content providers and advertisers, referred to as "clients," for display to occupants of the elevator cab 20. The information content, including advertising messages, may be provided in any suitable manner, for example, in still picture/banner or full motion video, and in any format, for example JPEG or MPEG. If provided in non-JPEG or non-MPEG format, the information content is converted to JPEG or MPEG format by suitable means, for example All Pro Video. Once obtained in the desired format, the information content is stored on the network mainframe server 10. Based on the initial information and advertising content, or any changes thereto, programmers utilize the XingTech MPEG Player sequencing software to generate the content loop for a particular building, or if desired, for a particular elevator cab 20. Once programmed, the content loop is downloaded to each elevator cab 20 in the building over the telephone line 50 and the data line 52 along with a play schedule to run the loop at specified, predetermined times and intervals during the peak office hours of the building. Whenever the information and/or or advertising content changes, the content loop is reprogrammed and downloaded to the elevator cab(s) 20 at the next available download period. Preferably, the network mainframe server 10 is only connected to the CPU 34 of the processing unit 30 when a download is occurring and when occupant data, as will be described, is being transmitted from the CPU 34 to the network server 10. However, if desired, the network server 10 may provide a real time connection to an on-line news, sports, weather, or financial information ticker, which will appear as a continuous banner across a portion of the monitor 36.

When installed and configured as described above and illustrated in FIG. 2, the elevator information and advertising system will provide audio/video information and advertising to building tenants and visitors to combat the socially stressful environment of an elevator cab in an urban high-rise office or professional building. Typically, the system will remain in continuous operation during the 10–14 hour business day from between about 6 am local time and about 8 pm local time depending on the schedule desired by the building owner, operator or manager. However, the system may be configured to acquire a series of electrical command signals from the elevator control panel 40 indicating when the doors 22 of the elevator cab 20 are open and closed, and to which floor the elevator cab 20 will travel next. From the data provided by the control panel 40, the CPU 34 can select an appropriate length of information and/or advertising material that corresponds to the duration of the elevator ride. In this manner, the information and advertising content messages will not be displayed while the elevator occupants are entering and leaving the elevator cab 20, and will not be exposed to only partial information and advertising messages during the ride to the next floor serviced by the elevator cab 20. If utilized, this feature would not interrupt the continuous display of on-line ticker information.

The system, and in particular the CPU 34 of the IPU 30, will be accessed over the telephone line 50 and the data line 52 after business hours to update the content loop with new information and advertising content, or to download an entirely new content loop. As previously stated, the CPU 34 utilizes the XingTech MPEG Player software to run the MPEG and JPEG audio/video files that contain the information and advertising messages downloaded to the elevator cab 20 from the network server 10. Importantly, the apparatus and method of the present invention operates as a "stand-alone" system that does not utilize a closed circuit television, LAN or Internet feed. Instead, the apparatus and method rely on temporary, rapid downloads of pre-programmed content loops over a WAN featuring high capacity, high transfer rate DSL communications provided by a LEC. Preferably, downloads are accomplished after business hours during off-peak telephone line usage and the DSL communications are terminated after the download is completed. As a result, the elevator information and advertising delivery system is cost effective to install, configure and operate in accordance with the stated objectives of the invention. In addition, the apparatus and method of the present invention permit daily programming of building information and announcements, thereby providing additional advantage to the building owner, operator, or manager, as well as the elevator occupants.

Figure 3:
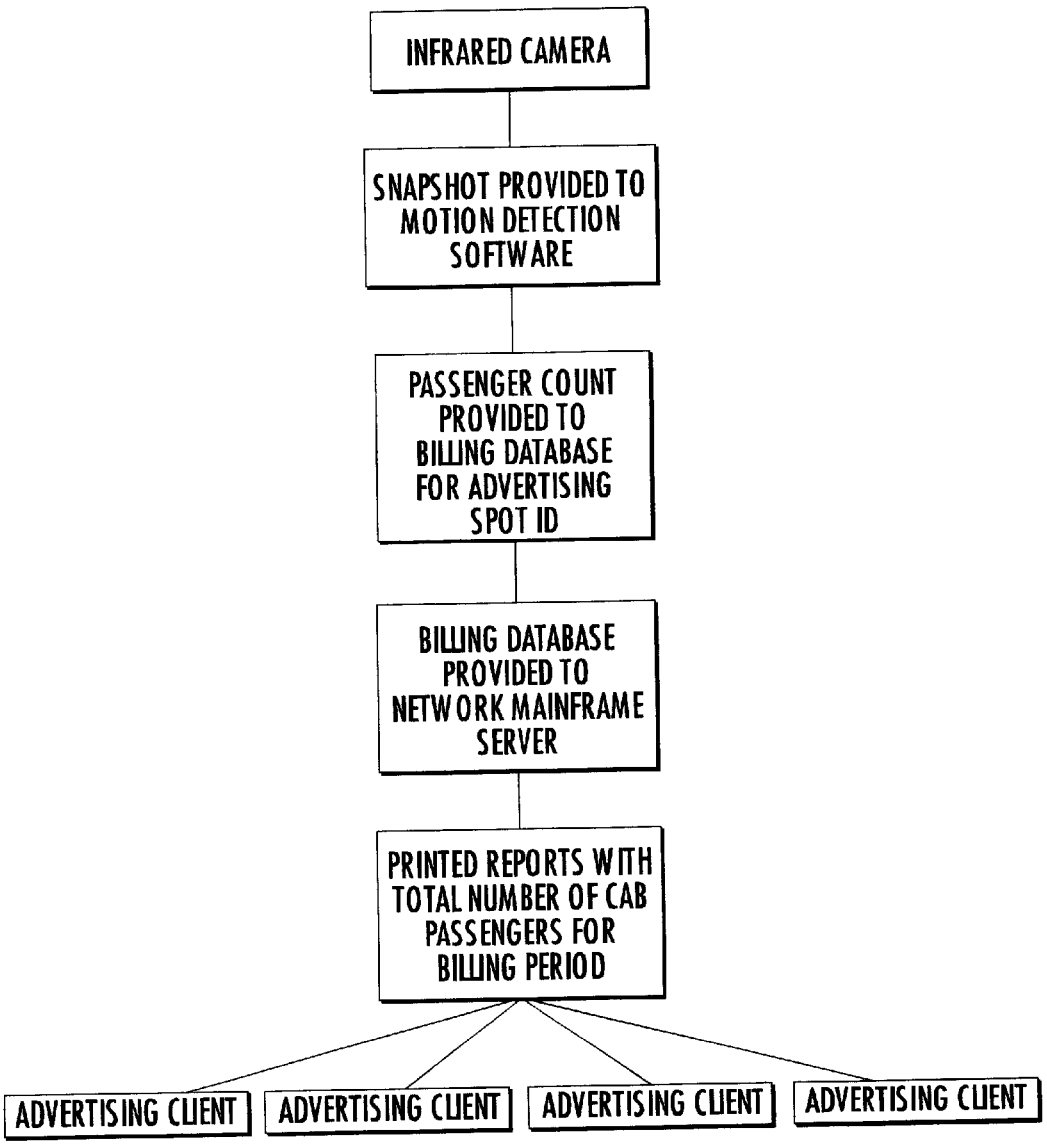
FIG. 3 is a flow chart illustrating an apparatus and method of reliably determining the number of occupants in an elevator cab for use with an elevator information and advertising delivery system according to the present invention.

As illustrated in FIG. 3, the elevator information and advertising delivery system of the present invention includes a novel method of acquiring occupant information for reporting and billing purposes. As previously mentioned, each elevator cab 20 is fitted with an infrared camera 40 and infrared imaging software for distinguishing heat emanations from individual occupants of the elevator cab 20. In particular, the infrared camera 40 has the capability to distinguish the number of individuals that are present in the elevator cab 20 during the display of a particular advertisement. The objective of acquiring the occupant information is to present each advertiser with an accurate headcount of the number of individuals that are exposed to a particular advertisement. The information may then be used by the advertiser to study the effectiveness of an ad campaign or to schedule an advertisement for more frequent, less frequent, or a different content loop timeslot. In addition, the occupant information is integrated by the system provider into the billing process to determine the advertising rates to be charged for various advertising messages on the content loop and to calculate the advertising fee to be charged to the advertiser. In a preferred embodiment, the infrared camera 40 takes a "snapshot" of the interior of the elevator cab 20 at the start of each advertisement to record optical images of the occupants. The snapshot of optical images is then provided to the motion detection software, for example infrared imaging software, for analysis to detect the number of occupants in the elevator cab 20 at the time the advertisement is displayed. The occupant, or passenger, count is stored in the CPU 34 billing database as an advertising spot ID and utilized to generate reports that are transmitted to an accounting and reporting database on the network mainframe server 10 via the WAN for use in the advertiser billing and reporting functions. The reports from the CPU 34 generated by the infrared imaging software are collected at the Home Office by the network server 10 and added to the main billing database for processing by the billing department on a period basis, such as monthly. Each advertiser client is then billed in accordance with predetermined billing rates for the number of "hits" generated by each advertisement. Thus, in accordance with the stated objectives of the invention, the method reliably determines the number of occupants in the elevator cab 20 that are exposed to each advertisement for the purposes establishing billing rates and collecting advertising revenues.

In summary, the elevator information and advertising system of the present invention provides information content providers, and in particular commercial advertisers, more effective and efficient use of advertising in elevator cabs to reach a targeted audience. Utilizing existing technology, the apparatus of the invention places high-resolution audio/video displays on monitors mounted in elevator cabs of high-rise office and professional buildings. In this unique environment, the information content provider and the advertiser are presented with a captive audience of consumers having demographics that are widely recognized as being highly desirable for many, if not most, advertisers. The information and advertising content will be displayed to the occupants of the elevator cab at a time of day that the consumer is typically unavailable. Furthermore, an accurate count of the number of individuals exposed to the advertisement will be recorded and reported to the advertiser for marketing effectiveness studies, as well as reliable and accurate billing. Although other elevator information and advertising delivery systems are presently in limited use, or are under development, none offers the unique combination of capability, cost effectiveness and reliability provided by the apparatus and method of the present invention.

While the invention has been described in terms of preferred embodiments to permit a person of ordinary skill in the art to make and practice the invention, it is not intended that the invention be construed so narrowly as to be limited to the specific embodiments disclosed herein. Rather, it is to be understood that the foregoing description is exemplary and explanatory only, and as such, is intended to provide an enabling disclosure of the invention without limiting the scope of the invention in any manner.

That which is claimed is:

1. An apparatus for delivering advertising messages to occupants of an elevator cab, the apparatus comprising a network mainframe server located remotely from the elevator cab; and an individual processing unit (IPU) located at the elevator cab and in communication with the network mainframe server over a telephone line configured for transmitting a data signal, the IPU comprising a central processing unit (CPU) for storing pre-recorded advertising messages and for replaying the pre-recorded advertising messages to the occupants of the of the elevator cab;

a monitor connected to the CPU for displaying the advertising messages to the occupants of the elevator cab; and an infrared camera connected to the CPU and provided with infrared imaging software for determining the actual number of occupants exposed to each of the advertising messages displayed on the monitor without identifying the occupants of the elevator cab.

2. The apparatus according to claim 1 wherein the infrared camera is optically connected to the CPU by a fiber optic cable.

3. The apparatus according to claim 1 wherein the IPU further comprises a speaker electrically connected to the CPU and wherein the advertising messages comprise audio/video files transmitted to the IPU from the network mainframe server.

4. The apparatus according to claim 1 wherein the telephone line comprises terminals located in the elevator cab and wherein the CPU is connected to the terminals of the telephone line by an xDSL data line.

5. The apparatus according to claim 4 wherein the terminals of the telephone line are further connected to an emergency phone located on a control panel in the elevator cab.

6. The apparatus according to claim 1 further comprising a power source electrically connected to the CPU for providing power to the IPU.

7. An apparatus for delivering advertising messages to occupants of an elevator cab, the apparatus comprising a network mainframe server located remotely from the elevator cab; and an individual processing unit (IPU) located at the elevator cab and in communication with the network mainframe server, the IPU comprising a monitor located for displaying the advertising messages to the occupants of the elevator cab; and an infrared camera connected to the network mainframe server and provided with infrared imaging software for detecting the actual number of occupants in the elevator cab when an advertising message is displayed on the monitor without identifying the occupants of the elevator cab.

8. The apparatus according to claim 7 wherein the IPU further comprises a central processing unit (CPU) for storing pre-recorded advertising messages and for replaying the pre-recorded advertising messages to the occupants of the elevator cab.

9. The apparatus according to claim 7 wherein the infrared camera is optically connected to the CPU by a fiber optic cable.

10. The apparatus according to claim 8 wherein the IPU further comprises a speaker electrically connected to the CPU and wherein the advertising messages comprise audio/video files transmitted to the IPU from the network mainframe server.

11. The apparatus according to claim 8 further comprising a telephone line having terminals located in the elevator cab and wherein the CPU is connected to the terminals of the telephone line by an xDSL data line.

12. The apparatus according to claim 11 wherein the terminals of the telephone line are further connected to an emergency phone located on a control panel in the elevator cab.

13. The apparatus according to claim 8 further comprising a power source electrically connected to the CPU for providing power to the IPU.

14. A method of displaying advertising messages to occupants of an elevator cab comprising the steps of providing a network mainframe server located remotely from the elevator cab;

providing an individual processing unit (IPU) located at the elevator cab and in communication with the network mainframe server, the IPU comprising a central processing unit (CPU) and a monitor connected to the CPU;

transmitting the advertising messages from the network mainframe server to the CPU of the IPU;

storing the advertising messages on the CPU of the IPU;

displaying the advertising messages to the occupants of the elevator cab on the monitor of the IPU;

providing an infrared camera connected to the CPU of the IPU; and using infrared imaging software, detecting the actual number of occupants in the elevator cab when an advertising message is displayed on the monitor of the IPU without identifying the occupants of the elevator cab.

15. The method according to claim 14 wherein the CPU is connected to a telephone line by an xDSL data line and the advertising messages are audio/video files transmitted from the network mainframe server to the CPU of the IPU.

16. The method of claim 14 comprising the further steps of using the infrared camera, taking a snapshot of the interior of the elevator cab when an advertising message is displayed to the occupants of the elevator cab;

providing the snapshot to motion detection software on the CPU to determine a passenger count.

17. The method of claim 16 comprising the further steps of providing the passenger count to a billing database on the CPU;

downloading the billing database from the CPU to the network mainframe server; and generating a billing report with an accurate passenger count of the number of occupants in the elevator cab when an advertising message is displayed.

18. The method of claim 14 wherein the infrared camera is optically connected to the CPU by a fiber optic cable.

* * * * *